US006997393B1

(12) United States Patent
Angold et al.

(10) Patent No.: US 6,997,393 B1
(45) Date of Patent: Feb. 14, 2006

(54) POP-UP IRRIGATION SPRINKLERS

(75) Inventors: Russdon D. Angold, Benicia, CA (US); Steve S. H. Han, Upland, CA (US); David E. Robertson, Glendora, CA (US)

(73) Assignee: Rain Bird Corporation, Glendora, CA (US)

( * ) Notice: Subject to any disclaimer, the term of this patent is extended or adjusted under 35 U.S.C. 154(b) by 0 days.

(21) Appl. No.: 10/944,019

(22) Filed: Sep. 17, 2004

(51) Int. Cl.
*B05B 15/10* (2006.01)

(52) U.S. Cl. ..... 239/205; 239/104; 239/114; 239/123; 239/203; 239/570; 239/571; 285/110

(58) Field of Classification Search ..... 239/203–207, 239/201, 104, 114, 123, 570, 571; 285/110, 285/302
See application file for complete search history.

(56) References Cited

U.S. PATENT DOCUMENTS 3,713,584 A * 1/1973 Hunter ..... 239/206
3,948,285 A * 4/1976 Flynn ..... 239/570
4,316,579 A * 2/1982 Ray et al. ..... 239/123
4,479,611 A * 10/1984 Galvis ..... 239/205
4,682,732 A * 7/1987 Walto ..... 239/123
4,913,352 A * 4/1990 Witty et al. ..... 239/104
5,375,768 A * 12/1994 Clark ..... 239/205
5,711,486 A * 1/1998 Clark et al. ..... 239/205
5,779,148 A * 7/1998 Saarem et al. ..... 239/571

* cited by examiner

*Primary Examiner*—Steven J. Ganey
(74) *Attorney, Agent, or Firm*—Manatt, Phelps, Phillips

(57) ABSTRACT

The pop-up irrigation sprinkler includes a pressure reducing valve, a spring-biased, pop-up riser, and a valve seal of unitary construction adjacent to the lower end of the riser having a valve body, a valve plug at the lower end of the valve body sealing the inlet port while the riser is in the retracted position, and a channel within the valve plug that is in fluid communication with the upper end of the valve body. The pressure reducing valve has a flow tube mounted for limited movement within the riser and lower port of the flow tube. The lower port of the flow tube is normally open when the riser is in the extended, operative position a pressure. The normally open lower port is urged against the upper surface of the valve plug when by a surge of pressurized water. A washer is provided in the lower end of the valve plug for sealing the inlet port from inflow and outflow of water from the sprinkler while the riser is in the retracted position.

12 Claims, 9 Drawing Sheets

POP-UP IRRIGATION SPRINKLERS

FIELD OF INVENTION

This invention relates to pop-up irrigation sprinklers, and more particularly, to pop-up sprinklers having new and improved valve seals.

BACKGROUND OF THE INVENTION

It is well known in the art to employ with pop-up type irrigation sprinklers a pressure regulator in the pop-up riser of the sprinkler to control and keep constant the pressure at which water from the sprinkler nozzle is ejected into the atmosphere. The use of such pressure regulators is particularly useful with pop-up sprinklers, which will be used where the source pressure supplied to the sprinkler may vary over wide ranges, such as typically found in residential applications or where the sprinklers are to be used in hilly terrain. By using a pressure regulator, the sprinkler nozzle will produce a spray pattern which will be substantially constant over a wide range of supply pressures, thereby assuring that optimum sprinkler performance is achieved even though the source pressure to the sprinkler may vary over wide ranges.

One such pressure regulator, which has been suggested for use within the pop-up riser of pop-up sprinklers, includes a flow seat secured within a lower portion of the stem or riser, and a flow tube that is mounted within the riser for limited reciprocation above the flow seat. The flow tube is typically spring-biased and centered within the riser by O-ring type seals that are disposed about the upper and lower end portions of the tube and which engage the inside side wall of the riser to seal the space between the outside of the tube and the inside of the riser between the seals. The flow tube raises and lowers relative to the flow seat to regulate the water from the source passing through the flow tube to the sprinkler nozzle in response to the inlet water pressure. By controlling the pressure to the nozzle through movement of the flow tube relative to the seat, a substantially constant water pressure at the nozzle can be maintained. A pop-up sprinkler of this pressure regulating stem (PRS) design and one having a grit-protected pressure regulator are respectively disclosed and claimed in U.S. Pat. Nos. 4,479,611 and 4,913,352, assigned to Rain Bird Corporation, which disclosure is incorporated by reference herein.

PRS pop-up sprinklers usually require either under-the-head check valves or built-in check values installed within the sprinklers below the flow tube to trap water in lateral irrigation pipes. Examples of the latter type are Seal-A-Matic™ check valves sold by Rain Bird Corporation. The Seal-A-Matic™ check valves eliminate the need for under-the-head check valves and are installed on commercially available PRS pop-up sprinklers. These check valves not only effectively trap water in lateral pipes, but they reduce wear on the irrigation sprinkler components by minimizing water hammer during initial operation.

There is a need for a pop-up sprinkler, having the advantages of the commercially available PRS pop-up sprinklers discussed in the above paragraph, with fewer parts, fewer manufacturing steps, a reduction in length, and lower cost.

BRIEF DESCRIPTION OF THE DRAWINGS

Further features and advantages will become apparent from the following and more particular description of preferred embodiments of the invention, as illustrated in the accompanying drawings in which.

BRIEF LIST OF REFERENCE NUMERALS UTILIZED IN THE DRAWINGS

Figure 1:
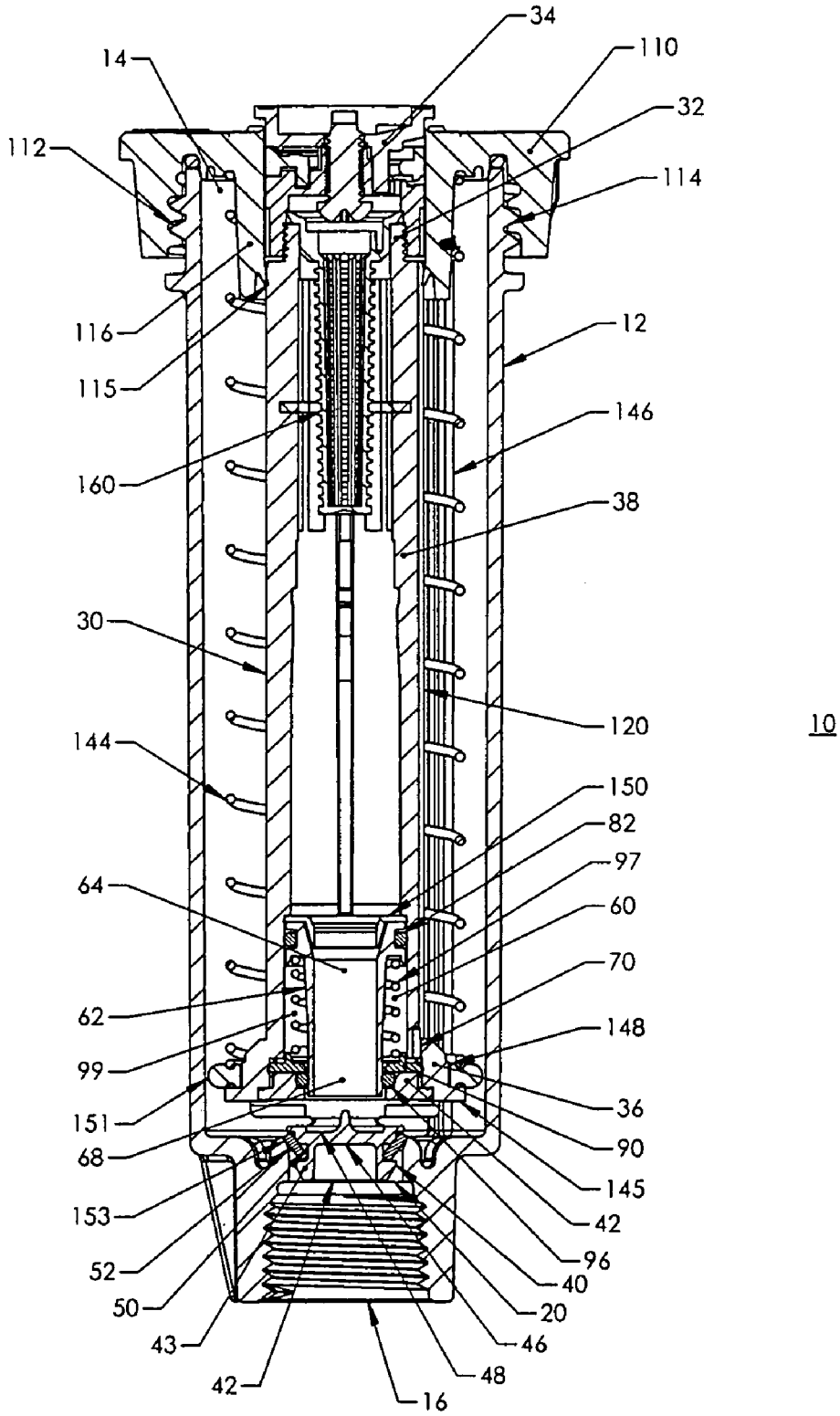
FIG. 1 is a vertical cross-sectional view of a pop-up irrigation sprinkler of a preferred embodiment of the present invention shown in its retracted position, taken substantially along line F—F of FIG. 1B.
Figure 1A:
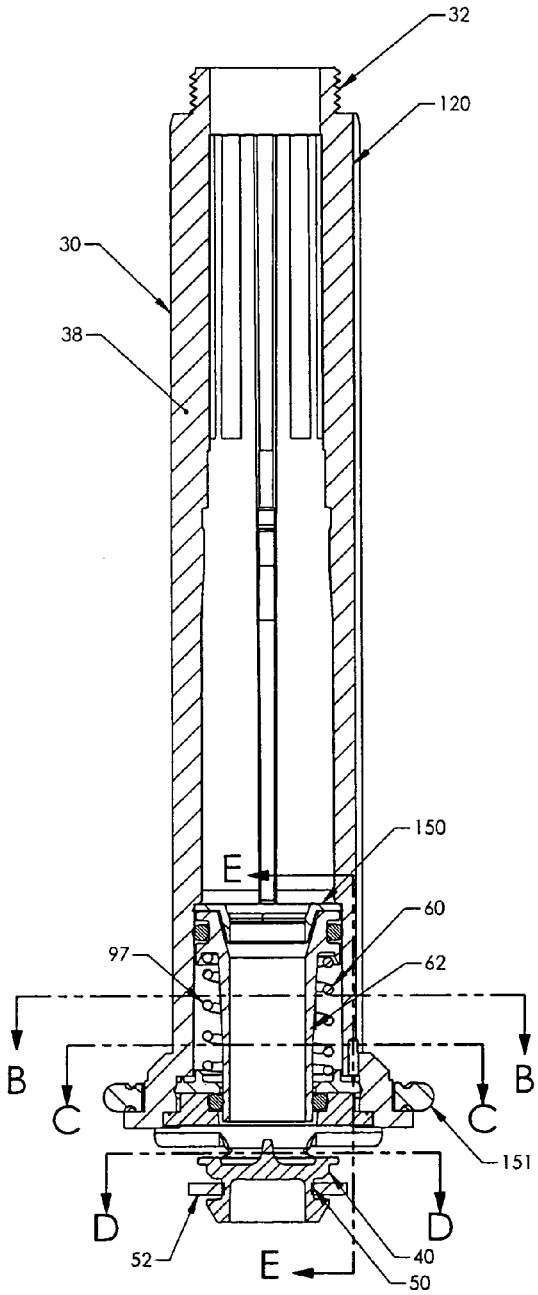
FIG. 1A is a vertical cross-sectional view of the embodiment shown in FIG. 1 with the sprinkler housing, cover, filter screen, and nozzle removed, taken substantially along line A—A of FIG. 1B.
Figure 1B:
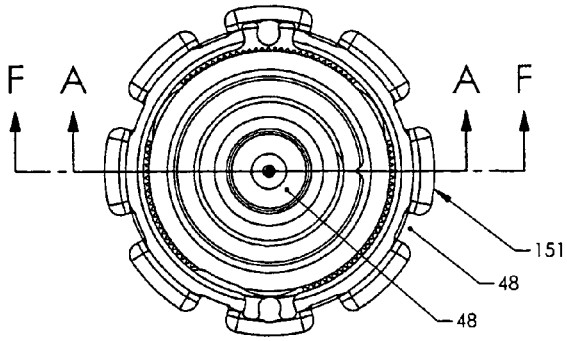
FIG. 1B is a top view of the embodiment shown in FIG. 1A.
Figure 1C:
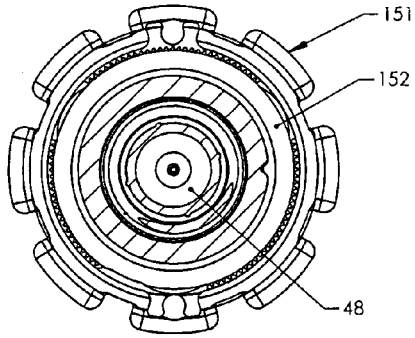
FIG. 1C is a horizontal cross-sectional view taken substantially along line B—B of FIG. 1A.
Figure 1D:
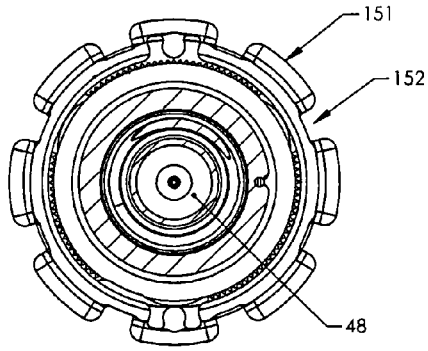
FIG. 1D is a horizontal cross-sectional view taken substantially along line C—C of FIG. 1A.

Elements:

10—sprinkler (10)
12—cylindrical housing (12)
14—upper end (14)
16—lower end (16)
20—threaded inlet port (20)
30—pop-up riser (30)
32—threaded upper end (32)
34—spray nozzle (34)
36—riser lower end (36)
38—sidewall (38)
40—valve seal (40)
42—valve body (42)
43—lower end (43)
44—valve plug (44)
46—lower interior surface (46)
48—upper surface (48)
50—circumferential groove (50)
52—retaining seal means (52)
54—channel(s) (54)
56—upper port (56)
58—cone (58)
59—gaps (59)
60—pressure reducing valve (60)
62—flow tube (62)

64—outlet port (64)
68—lower port (68)
70—vent port (70)
76—upper shoulder (76)
78—lower shoulder (78)
80—groove (80)
82—O-ring (82)
83—inner wall (83)
90—retainer (90)
92—groove (92)
94—shoulder (94)
95—lower surface (95)
96—O-ring (96)
97—control spring (97)
98—upper surface (98)
99—chamber (99)
100—upper inner vertical surface (100)
110—sprinkler cover (110)
112—housing threads (112)
114—cover threads (114)
115—central opening (115)
116—wiper seal (116)
120—slot(s) (120)
130—wiper seal upper surface (130)
132—wiper seal lower surface (132)
134—upper seal (134)
136—lower seal (136)
140—flange (140)
141—riser surface (141)
142—lower shoulders (142)
143—valve seal surface (143)
144—compression spring (144)
146—ribs (146)
147—flange surface (147)
150—tubular funnel (150)
151—adjusting guide (151)
152—notches (152)
153—housing surface (153)
160—filter screen (160)

DETAILED DESCRIPTION OF PREFERRED EMBODIMENTS OF THE PRESENT INVENTION

FIGS. 1–9 show various views of preferred embodiments of the present invention in which pressure regulated pop-up sprinkler 10 is an improvement over the pop-up sprinklers of the type marketed by Rain Bird Corporation under the 1800 Series of sprinklers.

In the present embodiment, sprinkler 10 includes a generally upright, cylindrical housing 12 having upper end 14 and lower end 16. Housing 12 is molded from a lightweight molded plastic, suitable for underground installation with the upper end 14 disposed substantially flush with the surface of the soil. Threaded inlet port 20 is formed with lower end 16 of housing 12 for coupling with a pressurized water source (not shown).

Pop-up riser 30, preferably spring-biased as discussed below, moves within housing 12 between an extended, operative position and the retracted position. Pop-up riser 30 has threaded upper end 32 for receiving spray nozzle 34, riser lower end 36, and sidewall 38 connecting upper end 32 and lower end 36. Spray nozzle 34 ejects water outwardly from sprinkler 10 when pop-up riser 30 is in the elevated spray position. FIG. 1 shows spray nozzle 34 in its retracted position within housing 12.

Figure 2:
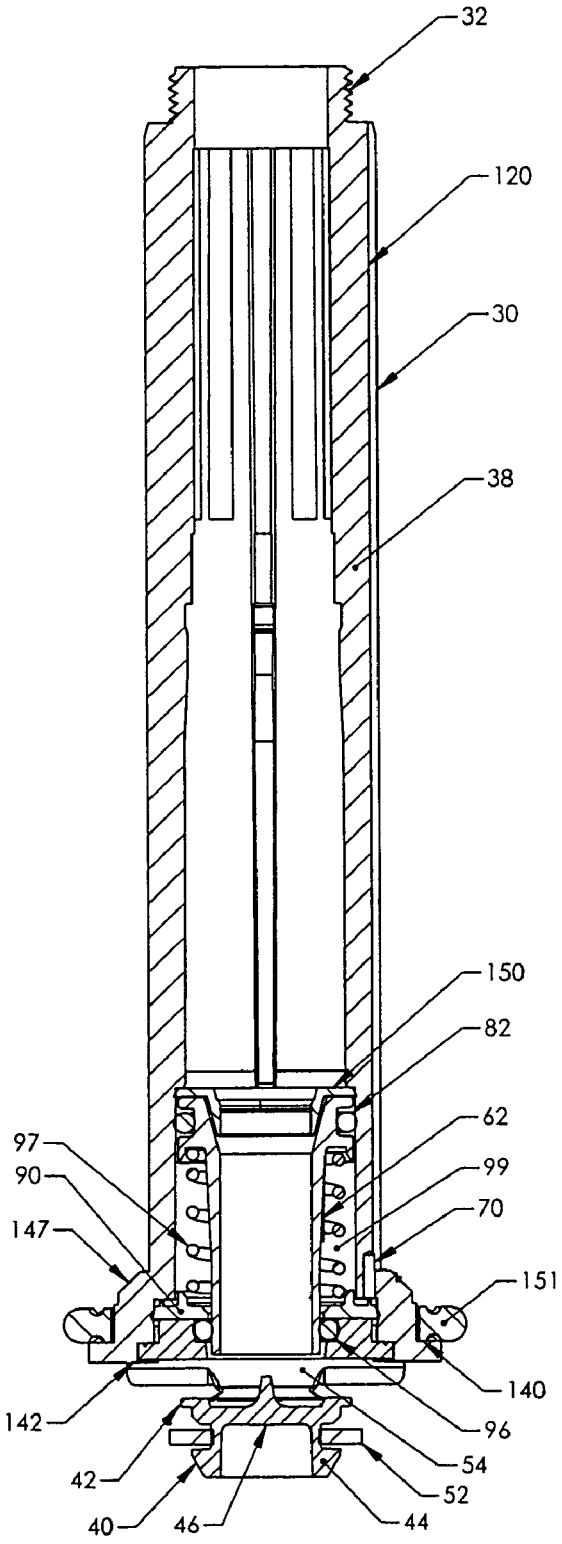
FIG. 2 is the same as FIG. 1A without the section lines.
Figure 5:
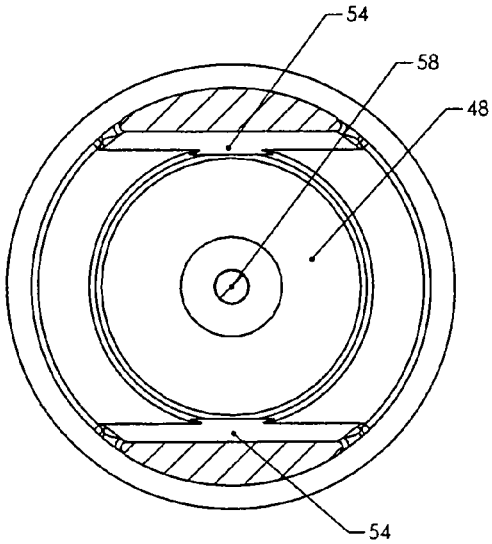
FIG. 5 is a horizontal cross-sectional view taken substantially along line D—D of FIG. 1A.
Figure 7:
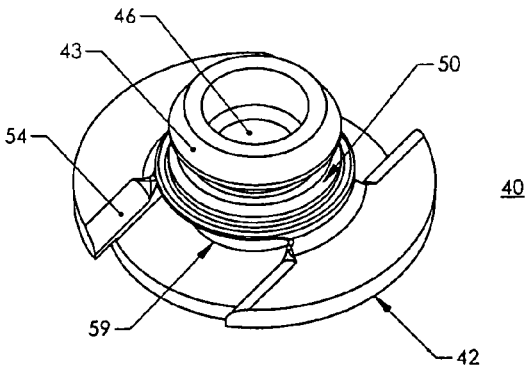
FIG. 7 is a perspective bottom view of the valve seal without the retaining seal means of the embodiment shown in FIG. 1A.
Figure 8:
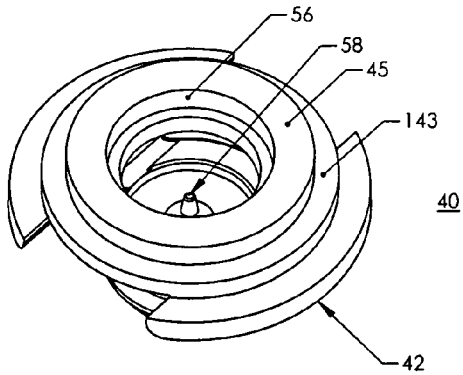
FIG. 8 is a perspective top view of the valve seal shown in FIG. 7.
Figure 6:
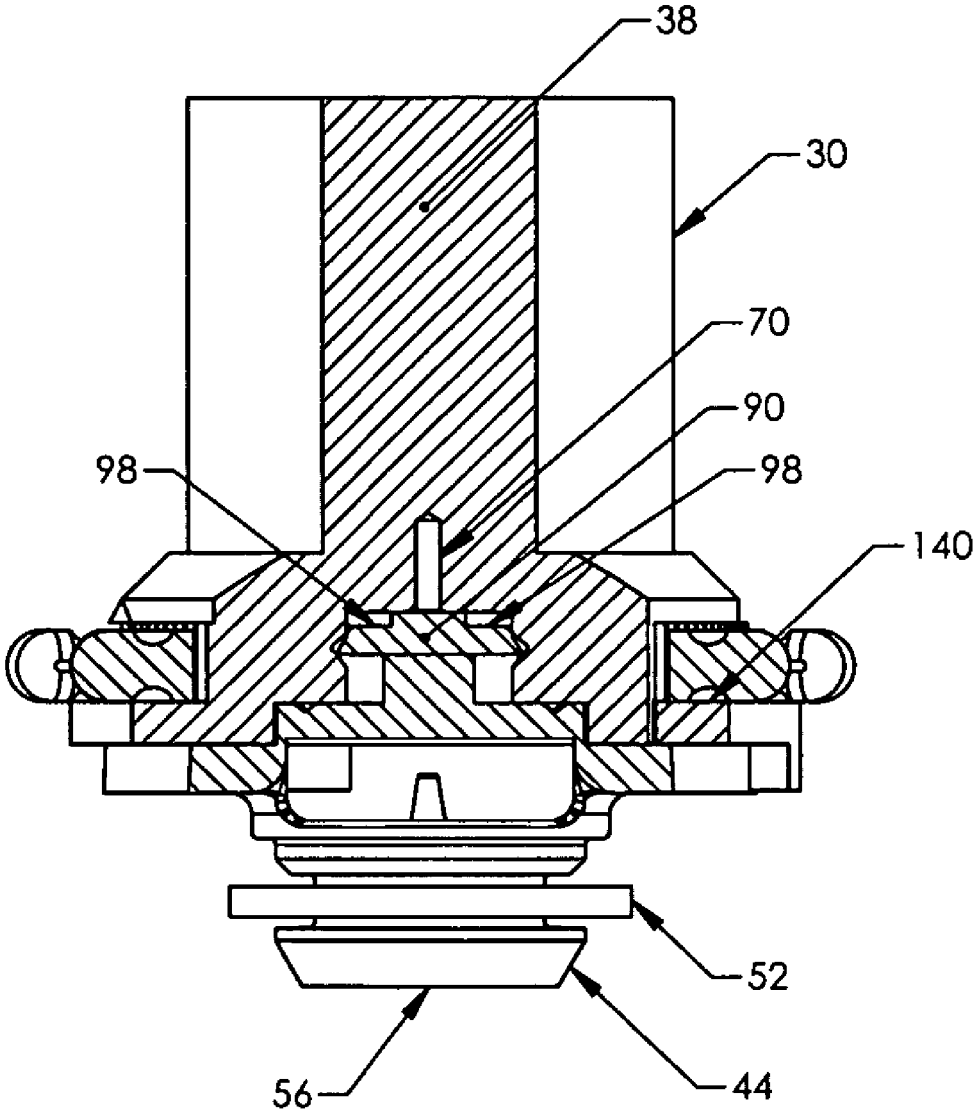
FIG. 6 is a vertical cross-sectional view taken substantially along line E—E of FIG. 1A.

Valve seal 40 shown in FIGS. 7 and 8 is disposed adjacent to lower end 36 of riser 30 and has valve body 42 having lower end 43 forming valve plug 44. Valve seal 40 is of unitary construction as shown in FIGS. 7 and 8 and is typically formed from a light weight and inexpensive molded plastic or the like. Valve plug 44 has lower interior surface 46, upper surface 48, and circumferential groove 50 adjacent lower interior surface 46 for receiving retaining seal means 52, which is shown in place within housing 12 in FIGS. 1 and 9. Seal means 52 can be a washer of an elastic material such as rubber. At least one channel 54, preferably two as shown in FIGS. 2, 5 and 7, is positioned in valve plug 44 between circumferential groove 50 and lower end 43 of value body 42. Upper port 56 of valve body 42 is in fluid communication with channels 54.

Valve plug 44 of relatively small cross sectional area is dimensioned to be received in relatively small circular inlet port 20 at lower end 16 of housing 12. Valve plug 44 has sufficient length to accommodate circumferential groove 50 for receiving seal means 52, which effectively seals inlet port 20 from inflow and outflow of water from housing 12 when riser 30 is in the retracted position as shown in FIG. 1. Cone 58 extends from upper surface 48 and is designed to divide the flow of water from the two channels 54 of valve plug 44. Valve body 42 has gaps 59 that are in fluid communication with channels 54.

Pressure reducing valve 60 is mounted within riser 30 to control and keep constant the pressure at which water from spray nozzle 34 is ejected into the atmosphere. Pressure reducing valve 60 has flow tube 62 mounted for limited longitudinal movement within riser 30. Flow tube 62 has a circular horizontal cross-section outlet port 64, and lower port 68 disposed adjacent upper port 56 of valve body 42. Open lower port 68 of flow tube 62 is urged against upper surface 48 of valve plug 44, without completely closing port 68, by a surge of pressurized water when riser 30 is in the extended, operative position. The diameter of outlet port 64 is substantially greater than the outer diameter of flow tube 62 to avoid any restriction while flow tube 62 moves within riser 30 to maintain a constant pressure during operation.

Pop-up riser 30 has vent port 70 located in sidewall 38 of riser 30 between upper end 32 and lower end 36, preferably adjacent to lower end 36 so that it is between upper port 64 and lower port 68 of flow tube 62. Vent port 70 provides an atmospheric reference vent for pressure reducing valve 60 as described below.

Flow tube 62 has upper shoulder 76 and lower shoulder 78 adjacent upper port 64 of flow tube 62 to form second groove 80 there between. O-ring 82 is mounted in groove 80 to provide the upper sealing means between flow tube 62 and inner wall 83 of riser 30. Retainer 90 adjacent to lower port 68 of flow tube 62 and is positioned between upper port 56 of valve body 42 and shoulder 94 formed within lower end 36 of riser 30. Groove 92 is formed between lower surface 95 of retainer 90 and upper port 56 of valve body 42 to receive O-ring 96 to provide a lower seal between flow tube 62 and upper inner vertical surface 100 of valve seal 40.

Control spring 97 is engaged between upper surface 98 of retainer 90 and the lower shoulder 78 of flow tube 62 in chamber 99. Spring 97 controls water pressure at upper port 64 of flow tube 62. When lower port 68 is urged against upper surface 48 of valve seal 40, control spring 97 is compressed to achieve the set pressure range at upper port 64 and to nozzle 34.

The pressure regulator 60 operates to control the pressure of water, typically 30 pounds per square inch (psi), supplied to nozzle 34 by controlling movement by flow tube 62 against the bias of the control spring 97 in response to the backpressure of water acting at upper port 64 on the downstream side of pressure regulator 60 within riser 30. As water under pressure is supplied to nozzle 34 through riser 30, backpressure upstream of nozzle 34 builds due to nozzle constriction. Backpressure upstream of nozzle 34 acts against upper shoulder 76 flow tube 62 and against the bias of control spring 97, lower shoulder 78 being exposed to atmospheric pressure within chamber 99 and providing a reference pressure for flow tube 62. Advantageously, the area of upper shoulder 76 of flow tube 62 is designed to have a larger area than that of the diameter of lower end 68 of flow tube 62. As a consequence of this design, the backpressure on upper shoulder 76 acts over a larger area than the pressure of the water entering lower end 16, thereby creating a force differential tending to urge the flow tube downwardly against the bias of control spring 97.

Sprinkler cover 110 is mounted by means of inter-engaging sets of housing threads 112 on upper end 14 of housing 12 and cover threads 114 on cover 110. Cover 110 has central opening 115 through which elongated, hollow cylindrical pop-up riser 30 is movable between a retracted position and an elevated spraying position. Cover 110 is provided with elongated annular wiper seal 116 formed of flexible material such as rubber or soft plastic, and which may be of the type shown are described in U.S. Pat. No. 4,316,579, and is disposed in opening 115.

Figure 3:
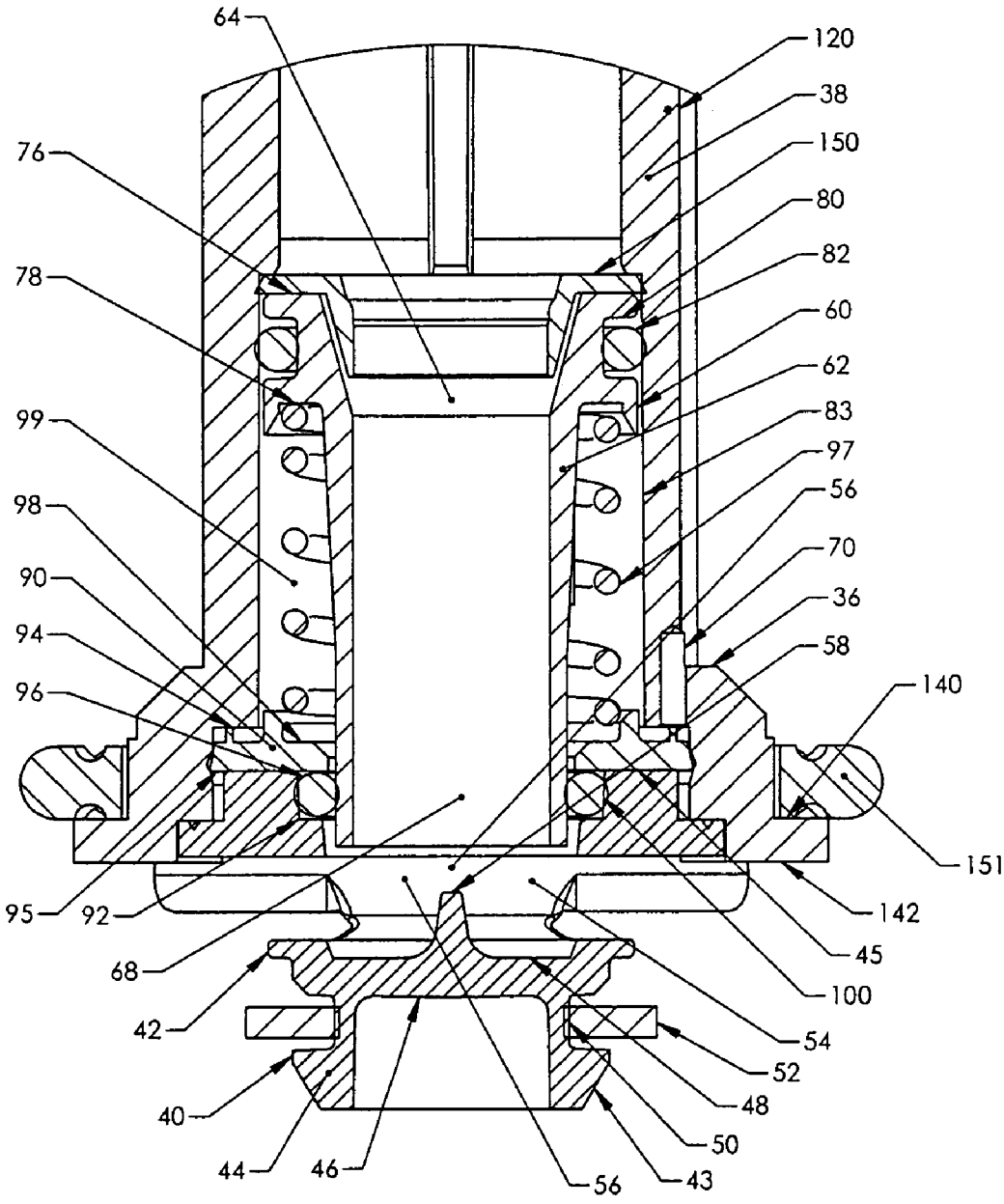
FIG. 3 is a cross-sectional view of the lower end of the embodiment shown in FIGS. 1A and 2.

Wiper seal 116 is designed to restrict passage of deleterious particulate material between sidewall 38 of riser 30 and cover 110. In addition, wiper seal 116 seals riser 30 when riser 30 is in the extended, operative position. At least one slot 120 is provided to extend from vent port 70 to create a gap between said cover 110 and vent 70 for optimal venting. FIGS. 2, and 3 show that two slots are provided in sidewall 38.

Lower end 36 of riser 30 has flange 140 projecting outwardly from riser 30. Ultrasonic welding or other attachment techniques securely fasten lower shoulders 142 of flange 140 to riser 30 in order to achieve a watertight attachment between riser surface 141 of riser 30 and valve seal surface 143 of valve seal 40.

Figure 4:
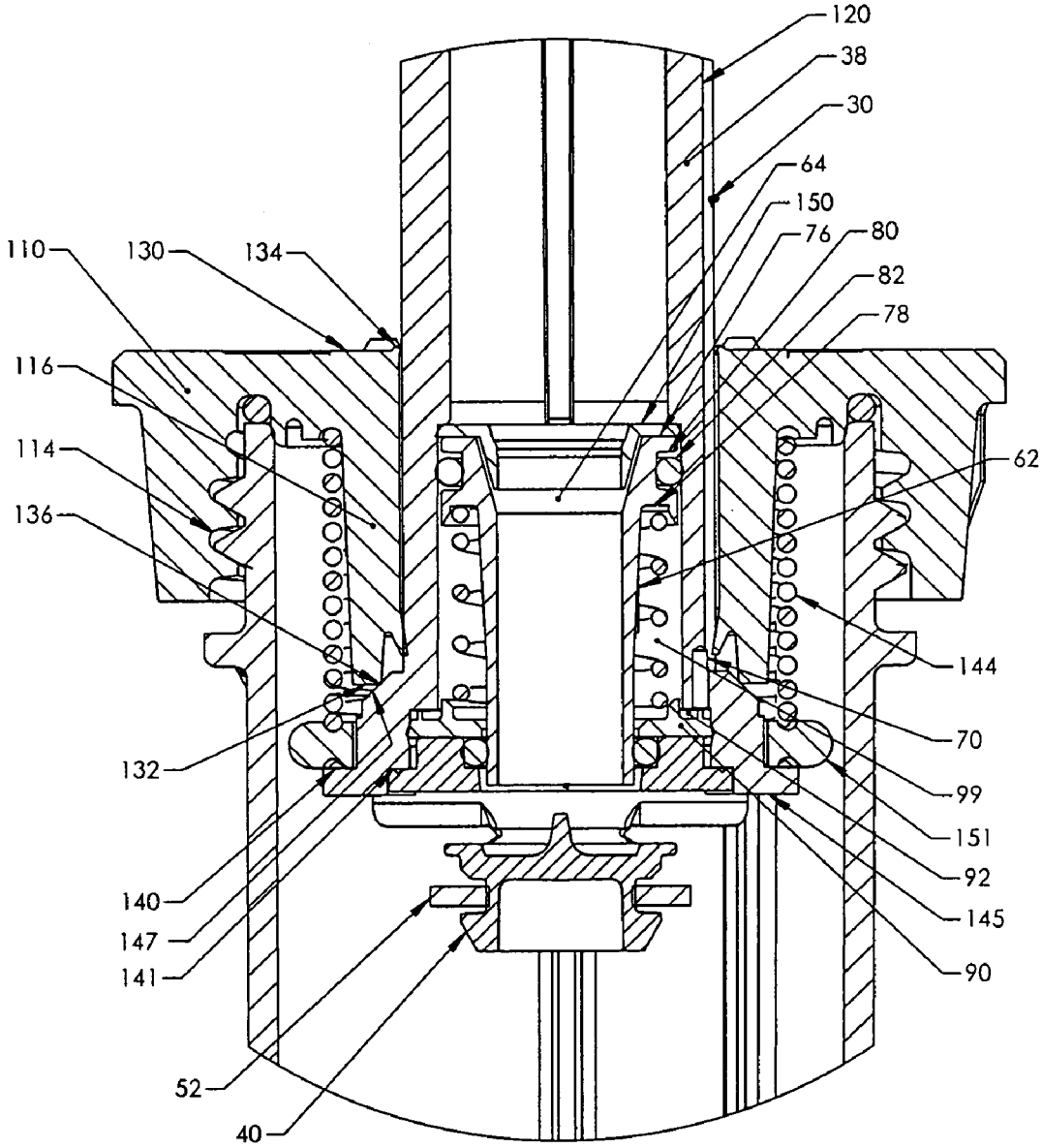
FIG. 4 is vertical cross-sectional view of the upper end of the sprinkler housing and the lower section of the pop-up riser of the embodiment shown in FIG. 1 in its extended, operation position.
Figure 4A:
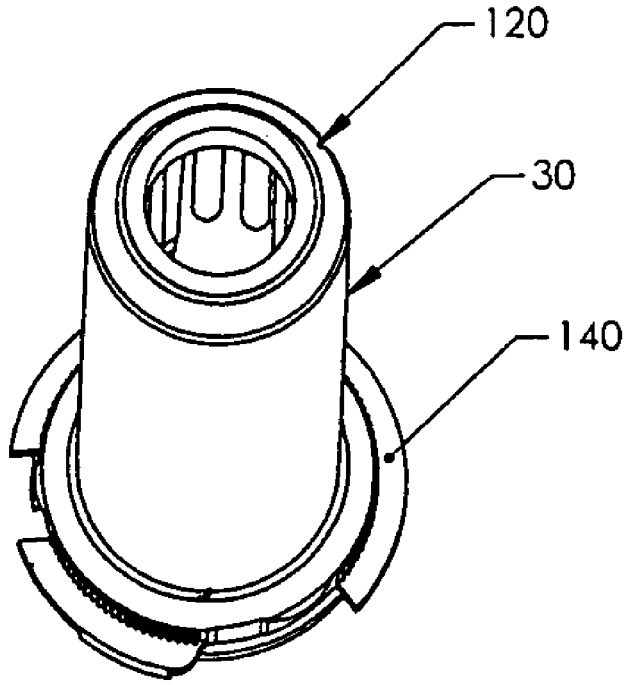
FIG. 4A is a perspective vertical view of the lower section shown in FIG. 4 to show a plurality of air vents.

FIG. 4 shows a detail of wiper seal 116 that has wiper seal upper surface 130 and wiper seal lower surface 132, an upper seal 134 positioned between upper surface 130 and side wall 38, and lower seal 136 between lower surface 132 and flange surface 147 of flange 140 when riser 30 is in the extended position.

Compression spring 144 is biased between adjusting guide 151 mounted on riser 30 adjacent flange 140 and the underside of cover 110 to provide spring-bias to pop-up riser 30 toward the retracted position as shown in FIG. 1 until the water pressure reaches a predetermined threshold pressure. Typically the threshold pressure is about 5 psi, at which time the water supply pressure acting on riser 30 will be sufficient to overcome the force of spring 144 and effect movement of pop-up riser 30 to the extended position shown in FIG. 4. During movement of riser 30 between the retracted and extended positions, riser 30 is restrained against rotation and guided by ribs 146 extending longitudinally along the inside of housing 12. Ribs 146 are slideably received within corresponding notches 152 formed in adjusting guide 151, as is conventional in pop-up sprinklers 10 of the sprinkler of the present invention illustrated in FIG. 1.

Figure 9:
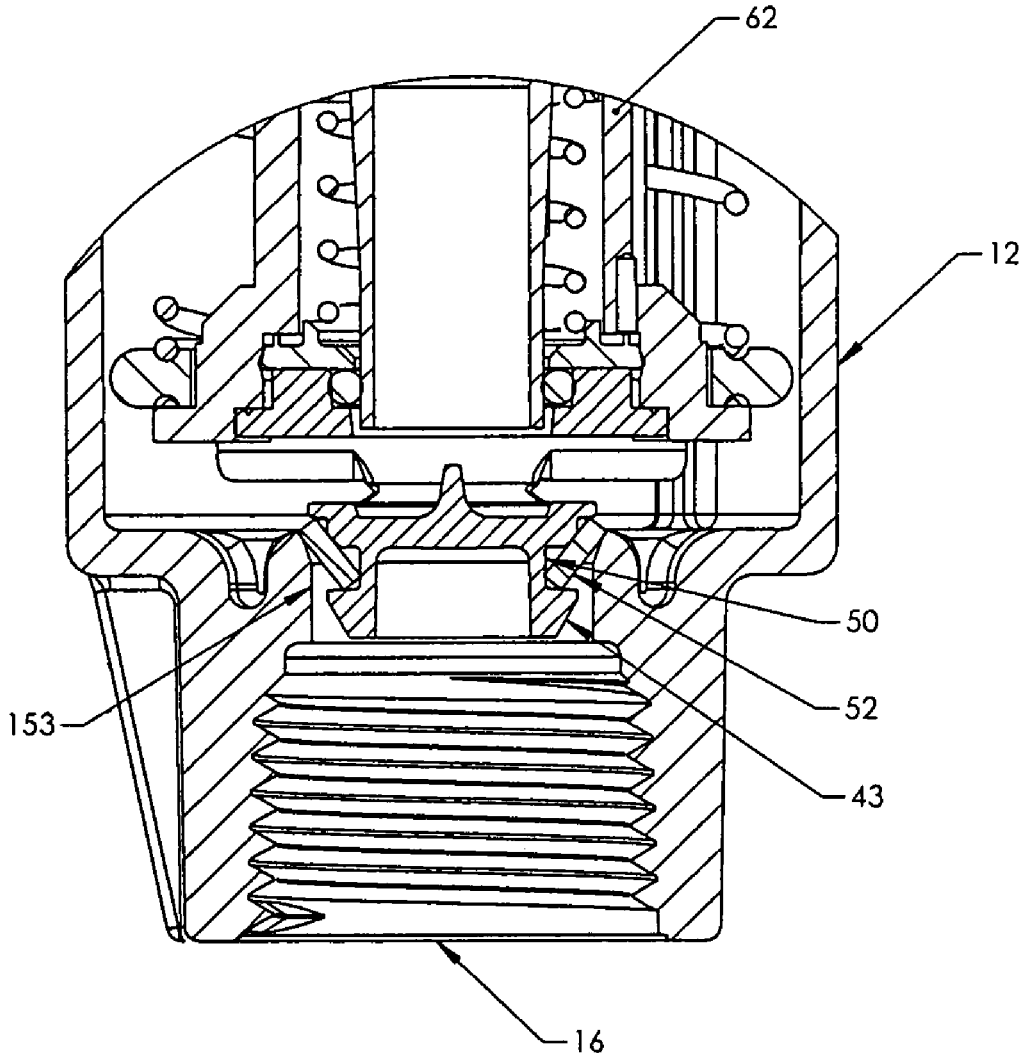
FIG. 9 is an enlarged vertical cross-sectional view of the lower quarter of the pop-up irrigation sprinkler of a preferred embodiment of the present invention shown in FIG. 1.

FIG. 9 more clearly shows that the combination of valve seal 40, washer 52, housing surface 153 seals against inflow of water from the water source unless and until the water pressure reaches or exceeds the predetermined threshold pressure sufficient to move riser 30 against the action of the spring 144. When water pressure is below the predetermined threshold, this combination prevents leakage or drainage of water through the sprinkler housing 12, thereby preventing water waste in the form of localized flooding or over watering of the soil immediately surrounding upper end 14 of housing 12. When the water supply is turned on and the supply line water pressure increases, flow through housing 12 is prevented until the pressure builds to a sufficient level to force riser 30 to extend against the bias of spring 144 to the elevated spraying position. After riser 30 is forced upwardly by the action of water pressure initially on valve plug 44, valve plug 44 is released from inlet port 20, water passes around flange 140 causing riser 30 to rapidly move against the bias of the spring 144 from the retracted position to the extended operational position.

In the operational position, with riser 30 extended above upper end 14 of housing 14, water flowing through riser 30 to nozzle 34 passes through the pressure regulator 60 which functions to regulate the pressure supplied to nozzle 34 so that a substantially constant pressure of inlet water enters nozzle 34. By controlling the pressure at nozzle 34, any given nozzle will operate to provide the same water distribution pattern regardless of the inlet water pressure, and also will permit a wide range of nozzle sizes to be operated at the same selected pressure level.

Valve seal 40 combines the features of a PRS sprinkler with a built-in check valve in the form of washer 52 that effectively traps water in lateral pipes in elevation changes of up to approximately 14 feet and reduces wear on the sprinkler system components by minimizing water hammer during start-up. The sprinkler of the present embodiment also prevents drainage from spray heads at lower elevations, stops water waste, and ends landscape damage due to flooding and/or erosion.

FIG. 4 shows vent port 70 is preferably positioned adjacent lower seal surface 132 of wiper seal 116 while riser 30 is in the extended, operative position. Vent port 70 has a generally circular or polygonal shape and is optimally sized to prevent debris intrusion or clogging in riser 30.

Tubular funnel 150 is preferably fixedly mounted within riser 30 and projects downwardly into upper port 64 of flow tube 62 for deflecting and directing grit and other particulate material downwardly from riser 30 into flow tube 62 when riser 30 is in its retracted position; see U.S. Pat. No. 4,913,352 for a detailed description of one type of tubular funnel suitable for this application.

To filter particulate material entering sprinkler 10 with the supply water before passing through spray nozzle 34, elongated filter screen 160 is mounted adjacent upper end 32 of riser 30 below nozzle 34 as shown in FIG. 1; see U.S. Pat. No. 4,913,352 for a detailed description of one type of filter screen suitable for this application. Water passing from riser 30 to nozzle 34 must flow through filter screen 160 which filters particulate material from the water before reaching nozzle 34.

Without departing from the spirit and scope of this invention, one of ordinary skill in the art can make various changes and modifications to the embodiment of the sprinkler of the present invention to adapt it to various usages and conditions. As such, these changes and modifications are properly, equitably, and intended to be, within the full range of equivalents of the following claims.

While certain embodiments of the present invention are shown in the drawings and described above in detail, it should be understood that there is no intention to limit the invention to the specific form or forms disclosed. On the contrary, the intention is to cover all modifications, alternative constructions, and equivalents falling within the spirit and scope of the invention. The present invention is limited only by the claims that follow.

What is claimed is:

1. A pop-up irrigation sprinkler comprising:

(a) a generally upright housing having a lower end and an upper end, a threaded inlet port formed within the lower end of said housing for coupling with a pressurized water source;

(b) a pop-up riser in said housing for movement between an extended position and a retracted position, having a threaded upper end for coupling a spray nozzle, a lower end, and a side wall connecting said upper end and said lower end;

(c) seal valve disposed adjacent to a lower end of said riser having a valve body having a lower end and an upper end, a valve plug having a lower surface and an upper surface at the lower end of the valve body for sealing said inlet port while said riser is in the retracted position, at least one channel within the valve plug, and an upper port in the upper end of said valve body in fluid communication with said at least one channel; and (d) a pressure reducing valve within said riser having a flow tube mounted for limited movement within said riser and having an upper port and a lower port disposed adjacent the upper end of said valve body;

said lower port of said flow tube capable of being closed by moving against the upper surface of said valve plug by backpressure of water when said riser is in the extended, operative position.

2. The sprinkler of claim 1, wherein said valve plug has a groove adjacent to the lower surface for receiving and retaining seal means for sealing said inlet port from inflow and outflow of water from said housing while said riser is in the retracted position.

3. The sprinkler of claim 1, wherein said riser has a vent port located in the side wall of said riser between said upper and lower ends to provide an atmospheric reference vent for said pressure reducing valve.

4. The sprinkler of claim 1, wherein said flow tube of said pressure reducing valve has an upper shoulder and a lower shoulder adjacent the upper port and a second groove formed between said upper and lower shoulders for receiving a sealing means to provide an upper seal between said flow tube and said riser.

5. The sprinkler of claim 1, wherein a retainer adjacent to the lower port of said flow tube of said pressure reducing valve is positioned between the upper end of said valve body of said seal valve and the shoulder formed within the lower end of said riser, said retainer forming a channel for receiving sealing means to provide a lower seal between said flow tube of said pressure reducing valve and said riser.

6. The sprinkler of claim 5, wherein a control spring engaged between an upper surface of said retainer and the lower shoulder of said flow tube for controlling water pressure at the upper port of said flow tube.

7. The sprinkler of claim 3, wherein upper end of said housing has threads, a cover engaging said threads, a wiper seal is disposed in an opening of said cover to restrict passage of deleterious particulate material between the side wall of said riser and said cover and to seal said riser when it is in the extended position, and at least one slot extending longitudinally from said vent port to said to said upper end of said riser to create a gap between said wiper seal and said vent port for optimal venting.

8. The sprinkler of claim 7, wherein the lower end of said riser has a flange projecting radially outwardly from said riser, said wiper seal has an upper surface and a lower surface, an upper seal positioned between the upper surface and the side wall of said riser and a lower seal positioned between the lower surface and said flange.

9. The sprinkler of claim 8, wherein said vent port is positioned below said lower seal surface of said wiper seal while said riser is in said extended, operative position.

10. The sprinkler of claim 9, wherein said vent port has a generally circular or polygonal shape optimally sized to prevent debris intrusion in said riser.

11. The sprinkler of claim 10, wherein a compression spring is biased between said flange and the underside of said cover for retaining said riser in the retracted position when said valve plug of said seal valve is closed against said inlet port of said housing and for preventing flow of water in and out of said housing until the supply water pressure reaches a predetermined threshold.

12. A pop-up irrigation sprinkler comprising:

(a) a generally upright housing having a lower end and an upper end, a threaded inlet port formed within the lower end of said housing for coupling with a pressurized water source;

(b) a pop-up riser in said housing for movement between an extended position and a retracted position, having a threaded upper end for coupling a spray nozzle, a lower end, and a side wall connecting said upper end and said lower end;

(c) seal valve disposed adjacent to a lower end of said riser having a valve body having a lower end and an upper end, a valve plug having a lower surface, an upper surface at the lower end of the valve body for sealing said inlet port while said riser is in the retracted position, a groove adjacent to the lower surface for receiving, and retaining seal means for sealing said inlet port from inflow and outflow of water from said housing while said riser is in the retracted position, at least one channel within the valve plug, and an upper port in the upper end of said valve body in fluid communication with said at least one channel; and (d) a pressure reducing valve within said riser having a flow tube mounted for limited movement within said riser and having an upper port and a lower port disposed adjacent the upper end of said valve body; said lower port of said flow tube capable of being closed by moving against the upper surface of said valve plug by backpressure of water when said riser is in the extended, operative position.

* * * * *